US010159887B2

(12) United States Patent
Jones

(10) Patent No.: US 10,159,887 B2
(45) **Date of Patent: *Dec. 25, 2018**

(54) METHOD FOR MAKING A WATER PERMEABLE AND WATER SHUTTLING SAND BUNKER

(71) Applicant: Casey Jones, Humble, TX (US)

(72) Inventor: Casey Jones, Humble, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/783,472

(22) Filed: Oct. 13, 2017

(65) Prior Publication Data

US 2018/0272222 A1 Sep. 27, 2018

Related U.S. Application Data

(63) Continuation of application No. 15/466,596, filed on Mar. 22, 2017, now Pat. No. 9,795,854.

(51) Int. Cl.

| | |
|---|---|
| ***A63B 57/00*** | (2015.01) |
| ***A63B 69/36*** | (2006.01) |
| ***E01C 13/02*** | (2006.01) |
| ***E02B 11/00*** | (2006.01) |
| ***A63B 57/30*** | (2015.01) |
| ***A63B 57/40*** | (2015.01) |
| ***A63B 57/10*** | (2015.01) |

(52) U.S. Cl.

CPC ..... *A63B 69/3691* (2013.01); *A63B 57/10* (2015.10); *A63B 57/357* (2015.10); *A63B 57/40* (2015.10); *E01C 13/02* (2013.01); *E02B 11/00* (2013.01)

(58) Field of Classification Search

CPC ..... E02B 11/00; A63B 69/3691

USPC ..... 473/168, 169, 173; 405/302.4–302.7

See application file for complete search history.

(56) References Cited

U.S. PATENT DOCUMENTS

| | | | | |
|---|---|---|---|---|
| 4,960,345 | A * | 10/1990 | Hurley | E01C 13/02 405/258.1 |
| 5,147,156 | A * | 9/1992 | Guettler | B65G 53/06 406/108 |
| 7,207,747 | B1 * | 4/2007 | England | E01C 13/02 210/170.01 |
| 7,399,145 | B2 * | 7/2008 | Clark | A63B 57/00 405/302.7 |
| 8,062,143 | B1 * | 11/2011 | Meersman | E01C 13/02 405/302.4 |
| 8,845,443 | B1 * | 9/2014 | Weaver | E01C 13/065 405/302.6 |
| 9,566,775 | B2 * | 2/2017 | Li | B09B 1/00 |
| 9,604,110 | B1 * | 3/2017 | Skawski, Jr. | A63B 57/0068 |
| 9,795,854 | B1 * | 10/2017 | Jones | A63B 69/3691 |

(Continued)

*Primary Examiner* — Mark Graham

(74) *Attorney, Agent, or Firm* — Buskop Law Group, P.C.; Wendy Buskop

(57) ABSTRACT

A method to create a water permeable and water shuttling sand bunker by forming a continuous bunker edge, installing a drain assembly, installing a synthetic tufted surface and a continuous integral edge overlapping polymer mesh, depositing a non-woven dual smooth surfaced geo-textile over the mesh and forming a sand layer. Water flows from the continuous bunker edge over the synthetic tufted surface and the non-woven dual smooth surfaced geo-textile to the drain assembly preventing the drain assembly from clogging, thereby forming a water permeable and water shuttling sand bunker.

21 Claims, 11 Drawing Sheets

(56) References Cited

U.S. PATENT DOCUMENTS

| | | | | |
|---|---|---|---|---|
| 2003/0082004 | A1* | 5/2003 | Wilkerson | E01C 13/02 405/43 |
| 2004/0156679 | A1* | 8/2004 | Jenkins | C09K 17/52 404/76 |
| 2006/0051161 | A1* | 3/2006 | Benson | E01C 13/02 405/43 |
| 2006/0193703 | A1* | 8/2006 | Carlson | E02D 17/205 405/302.4 |
| 2007/0237583 | A1* | 10/2007 | Corwon | E01C 13/02 405/37 |
| 2007/0278142 | A1* | 12/2007 | Clark | E01C 13/02 210/153 |
| 2011/0200401 | A1* | 8/2011 | Lemons | A63B 69/3691 405/302.4 |
| 2013/0116060 | A1* | 5/2013 | Allen | A63B 69/3661 473/173 |
| 2013/0184090 | A1* | 7/2013 | Sternberg | E01C 7/142 473/173 |

* cited by examiner

METHOD FOR MAKING A WATER PERMEABLE AND WATER SHUTTLING SAND BUNKER

CROSS-REFERENCE TO RELATED APPLICATIONS

The present application is a continuation of U.S. patent Ser. No. 15/466,596 filed on Mar. 22, 2017 for "Accelerated Water Removal Low Maintenance Multi-Hole Golfing Facility." This reference is hereby incorporated in its entirety.

FIELD

The present embodiments generally relate to a method for making a water permeable and water shuttling sand bunker.

BACKGROUND

A need exists for a a method for making a water permeable and water shuttling sand bunker that holds and maintains the established bunker edge.

A further need exists for a method for making a water permeable and water shuttling sand bunker with reduced contamination and clogging up of the drainage system with native soils, from around and under a golf facility.

The present embodiments meet these needs.

BRIEF DESCRIPTION OF THE DRAWINGS

The detailed description will be better understood in conjunction with the accompanying drawings as follows.

Figure 1:
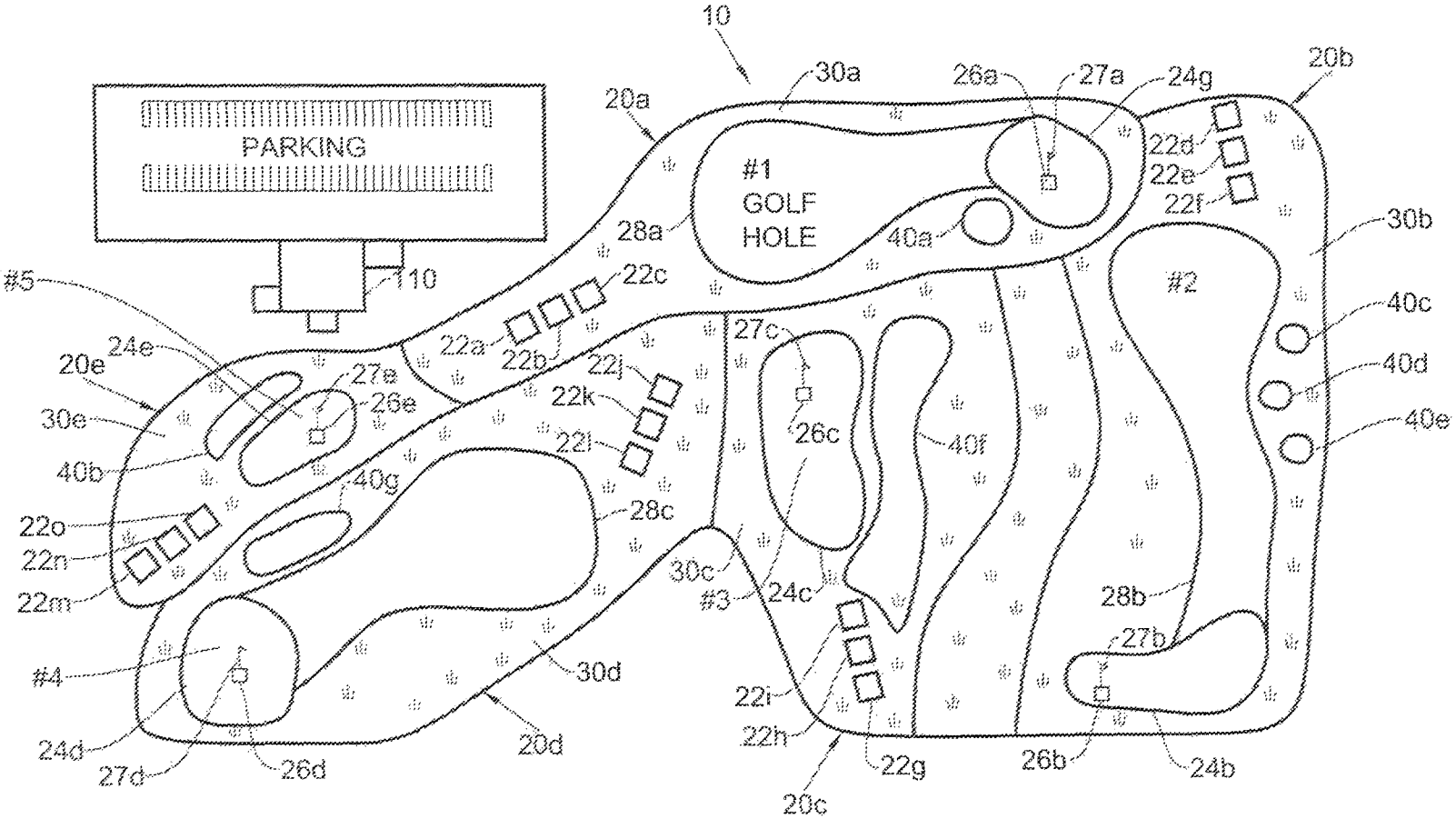
FIG. 1 depicts an accelerated water removal low maintenance multi-hole golfing facility with a sand bunker created according to the method.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The invention relates to a method for making a water permeable and water shuttling sand bunker for a multi-hole golfing facility.

The embodiments create a water permeable and water shuttling sand bunker to hold sand when the water permeable and water shuttling sand bunker walls slope over 30 degrees, such as at 35 degrees from the ground surface.

In the embodiments, the method creates a water permeable and water shuttling sand bunker of the golf course holds and maintains an established bunker edge.

The embodiments form a sand bunker that maintains a United States Golf Association (USGA) type gravel drainage system, which has a defined flow rate to maintain all sand bunkers consistently to specifications determined by the USGA.

The embodiments create a water permeable and water shuttling sand bunker that reduces rainfall washouts at a golf facility.

The embodiments allow the synthetic tufted surface to hold sand in place within the sand bunker.

The method for making a water permeable and water shuttling sand bunker results in reduced maintenance costs.

The embodiments prevent native soil from around and under a golf course contaminating a sand bunker of a golf course.

In embodiments, the structure of the sand bunker created by the method prevents worms and other animals from burrowing into the sand bunkers or sod adjacent to the sand bunkers, reducing maintenance. For example, gophers, deer, pigs, and dogs are prevented from digging up the sand bunker and adjacent sod, with the special structure.

The method for making a water permeable and water shuttling sand bunker reduces contamination and clogging up of the drainage system with native soils, from around and under a golf facility.

The method for making a water permeable and water shuttling sand bunker is usable at a multi-hole golfing facility that has a plurality of golf holes.

The method is usable on sand bunkers adjacent or near golf holes with a tee for striking a golf ball, a green comprising sod for each golf hole, a cup for holding a pin with a flag positioned in each green, each cup positioned apart from a tee providing a target, a fairway sod comprising sod between the tees and the cup; and a rough sod comprising sod, surrounding each fairway sod.

The method for making a water permeable and water shuttling sand bunker can be used to create water permeable and water shuttling sand bunkers positioned adjacent to a green, fairway sod 28*c*, or a rough sod Each water permeable and water shuttling sand bunker made by the method has a continuous bunker edge performing as a perimeter of the water shuttling sand bunker.

The water permeable and water shuttling sand bunker a drain assembly formed by the method is positioned at a location to receive water falling on sand within the continuous bunker edge.

The drain assembly has a drainage trench, a drainage pipe that fills between 30% and 40% of the drainage trench, and an aggregate material surrounding the drainage pipe.

The water permeable and water shuttling sand bunker formed by the method has a synthetic tufted surface positioned to extend from the continuous bunker edge to the drain assembly without covering the drain assembly.

More specifically the method for making a water permeable and water shuttling sand bunker positioned either: adjacent at least one of: the tee, the green, the fairway sod, and the rough sod; involves first forming a continuous bunker edge by first forming a perimeter of the water permeable and water shuttling sand bunker.

The method includes creating a drain assembly positioned at a location to receive water falling on the water permeable and water shuttling sand bunker within the continuous bunker edge; by the steps of: digging a drainage trench; installing a drainage pipe that fills from 30% and 40% of the drainage trench; and inserting an aggregate material surrounding the drainage pipe in the drainage trench.

The method includes installing an overlapping polymer mesh on a sod side mounted under the sod of a green, fairway sod or rough sod and on a middle section mounted over the continuous bunker edge integrally connected to the sod side.

Using the method, an anchor is formed by mounting a sand side under the synthetic tufted surface.

With this method a non-woven dual smooth surfaced geo-textile is positioned to cradle the drain assembly, with the geo-textile positioned under from 5% to 30% of the synthetic tufted surface in doing so, the non-woven geo-textile is configured for allowing water flow and water filtration while simultaneously excluding sand from entering the drain assembly.

The method involves placing a sand layer over the one piece synthetic tufted surface within the continuous bunker edge, wherein the sand layer is simultaneously sufficiently thick to support a golfer and sufficiently porous to enable water removal at a flow rate of from 6 to 24 inches of rain fall per hour, the sand layer comprising less than 2% fines, disposed over the one piece synthetic tufted surface, wherein the sand layer and one piece synthetic tufted surface provide a real time indicator for maintenance by golf course maintenance crews.

The method forms a sand bunker providing water to flow from the continuous bunker edge over the one piece synthetic tufted surface through the non-woven dual smooth surfaced geo-textile to the drain assembly preventing contamination and clogging of the drain assembly while permitting a water flow rate from 6 inches to 24 inches of rain fall per hour.

In embodiments, the water permeable and water shuttling sand bunker created by the method has a continuous integral edge overlapping polymer mesh with a sod side mounted under the sod of a green, fairway sod or rough sod, a middle section mounted over the continuous bunker edge, and a sand side mounted under the synthetic tufted surface.

The continuous integral edge overlaps polymer mesh for shuttling water flow from the continuous bunker edge.

In embodiments, the continuous integral edge overlaps polymer mesh used in the method has holes only large enough to accommodate grass root penetration from sod and creating an anchor.

The water permeable and water shuttling sand bunker made by the method has a non-woven dual smooth surfaced geo-textile encapsulating the drain assembly, positioned under from 5% to 30% of the synthetic tufted surface.

The non-woven dual smooth surfaced geo-textile is configured for allowing water flow and water filtration while simultaneously excluding sand from entering the drain assembly.

The water permeable and water shuttling sand bunker formed by the method has a sand layer sufficiently thick enabling a golfer to stand on the sand while sufficiently porous to allow water penetration, the sand layer comprising less than 2% fines, disposed over the plurality of segmented synthetic tufted surfaces within the continuous bunker edge; and The multi-hole golfing facility that uses the method to create the water permeable and water shuttling sand bunker is able to flow water from the continuous bunker edge over the synthetic tufted surface the non-woven dual smooth surfaced geo-textile to the drain assembly preventing the drain assembly from clogging, thereby maintaining an unclogged drain assembly for the water shuttling sand bunker.

The method teaches installation of a sand bunker system that is easy and fast and can create completed sand bunkers at a rate of from 4000 to 5000 square feet in a single day.

The present invention is easily repairable, and once the sand is removed from the sand bunker, the polymer mesh and the geo-textile fabric can be removed within fifteen to 30 minutes, for cleaning or replacement.

The method creates a water permeable and water shuttling sand bunker with a easily viewable warning system for maintenance crews to see when low sand levels are occurring in sand bunkers to perform preventive maintenance before damage to the sand bunkers occurs.

The following terms are used herein:

The term "accelerated" refers to an improved flow rate of water over the synthetic tufted surface in a water permeable water shuttling sand bunker that is between 10% and 15% quicker in feet per second than conventional drainage system.

The term "adhesive" as used herein refers to a material that bonds the tufted strips together and to the non-woven dual smooth surfaced geo-textile and overlapping polymer mesh The term "aggregate material" refers to particles with diameters ranging from $1/16^{th}$ inch to $3/8^{th}$ inch. The particles can be random sized, typically angular to allow maximum fluid flow.

The term "contamination" refers to introduction of at least 5% by weight based on the total amount of sand in the sand bunker of non-sand material into a sand bunker which term includes, soil, sticks, plastic bags, water bottles, pencils, paper, rocks.

The term "continuous bunker edge" refers to a continuous perimeter of the water permeable and water shuttling sand bunker which can have various random shapes, such as ellipsoid shapes, circular shapes, dog bone shapes, kidney shapes, shapes of cartoon characters, shapes of letters, shapes of other identical animal shapes, such as a hog or a swan.

The term "cup" is the receptacle about 6 inches in diameter that a golf ball is putted into to determine a final score for the golfer for the golf hole.

The term "drain assembly" refers to an assembly for deliberate and controlled removal of water surface runoff and subsurface water runoff. The drain assembly provides a healthy environment for greens, improves course playability, allows timely maintenance and thus yields increased golf course revenues. In embodiments, the drain assembly specifically includes a drainage trench, a drainage pipe, and aggregate material surrounding the drainage pipe.

The term "drainage pipe" refers to a perforated pipe, which can be tubular, including a square tubular for transferring water out of the drain assembly. In embodiments, the drainage pipe fills from 30% to 40% of the drainage trench. The drainage pipe in embodiments can be formed from rigid plastic, or shape holding semi-rigid, flexible filter fabric made from polypropylene, or polyethylene filter fabric such as a US 90 NW slit available from US Fabrics of Ohio. In embodiments, the filter fabric can contain a plurality of slits allowing water transfer without particle transfer.

The term "drainage trench" is either a dug hole in earth in the form of a linear conduit, or a formed conduit in the earth into which the drainage pipe is installed longitudinally. In embodiments, the drainage trench has a width from 4 inches to 12 inches. The height of the drainage trench can range from 10 inches to 16 inches. The length of the drainage trench is slightly shorter than a longitudinal axis of the water permeable and water shuttling sand bunker while protruding from the water permeable and water shuttling sand bunker providing an exit point for the water flowing from the drainage pipe contained in the drainage trench. In embodiments, the drainage trench by volume holds the aggregate material and drainage pipe in a ratio of from 60:40 to 70:30 of aggregate: drainage pipe.

The term "fairway sod" refers to the part of the golf course where the grass is cut greater than ¼ inch but less than ¾ inch between the tee and the green containing the cup, exclusive of the rough sod, trees, and hazards. A fairway sod can be formed from sod.

The term "fasteners" refers to a galvanized steel 6 inch u shaped staple, or similar device to hole the overlapping polymer mesh to another substrate, such as wood when the multi-hole golfing facility is located on moveable surface, such as a barge.

The term "golf hole" refers to the combination of elements that enable a golfer to hit a ball at one end towards a target with a cup and end pin according to the rules of the United States Golfing Association in effect as of March 2017 and the Royal and Ancient Golf Club of St. Andrews in effect as of March 2017.

The term "green" refers to a surface over which a golf ball will roll that is located near the pin. A green is made up of sod surface. The green, unlike rough sod, has short, hybrid grass or synthetic grass that extends about ¼ inch from the surface of the sod.

The term "low maintenance" refers to sand bunkers which require both (i) from 40% to 80% maintenance repair time by maintenance crews (including greens keepers) and (ii) from 10% to 20% contamination of sand by native soil or other material while providing a real time indicator to golf course maintenance of the need to replenish sand levels.

The term "multi-hole golfing facility" refers to at least one of a 9 hole, 18 hole, 27 hole, 36 hole, and 54 hole golf course, including but not limited to a chip and putt golf course, driving range, golf practice or training golf facility or any other golf course that has at least two holes. Embodiments contemplate the multi-hole golfing facility can be a mobile structure, such as a cruise ship, or floating barge with the golf course installed over plastic, or wood or a similar non-soil material, which in embodiments could be a composite.

The term "non-permeable base" refers to a flexible polymer layer that is solid and supports the synthetic tufts.

The term "non-woven dual smooth surfaced geo-textile" refers to a permeable textile material used to increase soil stability, provide erosion control or aid in drainage. The non-woven dual smooth surfaced geo-textile allows water flow and water filtration while simultaneously excluding sand from entering the drain assembly. The non-woven dual smooth surfaced geo-textile 80 provides cross-plane filtering with an apparent opening size (AOS) of at least about 0.212 and a thickness greater than about 1.0 mm at 2 kPa normal load and with an approximate mesh opening of #70 US Sieve. The non-woven dual smooth surfaced geo-textile includes high-modulus polymeric filaments comprising monofilaments or multifilament.

The term "one piece synthetic turfed surface" refers to a surface of synthetic fibers made to look like natural grass and includes a non-permeable base, such as a base of polypropylene from which the synthetic tufted fibers protrude from. The synthetic fibers generally protrude in a range from ¾ inch to 1 inch and wherein the tufts are spaced from $5/16^{th}$ inch to ⅜ inches apart. The non-permeable base is a flexible bendable but non-deforming non-breaking material which remains intact at temperatures from 6 degrees Fahrenheit to 125 degrees Fahrenheit.

The term "overlapping polymer mesh" refers to a continuous, and integral non-woven polymer mesh, such as a mesh made from polyvinyl chloride. The mesh is a single layer or a dual layer construction. In embodiments, the two layer overlapping polymer mesh is a dual layer mesh material, each layer having pores. The first layer of the dual layer mesh material can be oriented in a first direction and a second layer of the dual layer mesh material can be positioned directly over and flush with the first layer and oriented in a second direction that is 90 degrees to the first orientation. The continuous integral edge refers to overlapping polymer mesh that has a sod side, a middle section, and a sand side. In embodiments, the continuous integral edge overlapping polymer mesh 70 has holes only large enough to accommodate grass root penetration from sod to create an anchor between the sod and the synthetic tufted surface.

The term "pin" refers to a stick with a flag that is removable, inserted in a cup to provide a target to a golfer at a tee while the golfer is striking a golf ball at the tee or from a fairway sod or from a rough sod or a water permeable and water shuttling sand bunkers.

The term "real time indicator" refers to the instantaneously visual information obtained by golf course maintenance crews by camera, or by other surveillance that sand levels over the one piece synthetic tufted surface in the sand bunker are nearing a thickness of 1 inch or less.

The term "rough sod" refers to areas on a golf course outside of the fairway sods that generally feature higher, thicker grass with a height from 1 inch to 3 inches or naturally growing (unmaintained such as, not mowed) vegetation. Each rough sod contains sod.

The term "sand layer" refers to the playing surface within the perimeter of the water permeable and water shuttling sand bunker which has a depth that ranges from 2 to 4 inches and is 100% sand.

The term "segmented tufted synthetic strips" refers to small sections of the synthetic tufted surface which have been adhered together to form the one piece synthetic tufted surface.

The term "sod" as used herein refers to an earth bound grass system or a synthetic sod with fasteners, such as staples for connecting the synthetic sod to a surface.

The term "synthetic tufts" refers to grass like fibers extending from the non-permeable base. In embodiments all synthetic tufts extend in various direction away from the same side of the non-permeable base.

The term "tee" refers to the assembly at a specific location on the multi hole golfing facility where a golfer stands to strike a golf ball at the start of golf play for a given hole, and can include, sod, a device for supporting the golf ball for hitting at various heights. The sod is short cut, such as having a height under % inch.

The term "water permeable and water shuttling sand bunker" refers to shallow pits filled with sand and generally incorporating a raised lip which is referred to herein as "a continuous bunker edge".

The term "water removal" refers to flowing of water from a sand bunker into a drainage pipe. Water removal would be continuous during a rain storm.

Now turning to the Figures, FIG. 1 depicts a multi-hole golfing facility 10 which has a water permeable and water shuttling sand bunker made according to the method.

The multi-hole golfing facility 10 has a plurality of golf holes 20*a*-20*e*.

Each golf hole 20*a*-20*e* has a tee. Tees 22*a*-22*o* are shown. Tees have sod 25*a*-25*o* (shown in other Figures) for providing a location for striking a golf ball.

Each golf hole has a green sod 24*a*-24*e* for receiving a golf ball. The green sod has a cup 26*a*-26*e* positioned in the green sod 24-*a*-24*e*. The cup is configured to hold a pin 27 with a flag 29 (shown in FIG. 6) for receiving a golf ball.

In embodiments, each golf hole 20*a*-20*e* can have fairway sod. Three golf holes are shown having sod 28*a*-28*c*. Fairway sod is generally positioned between a tee and a green.

Some golf holes 20*a*-20*e* have rough sod 30*a*-30*e*. Rough sod is positioned adjacent to at least one of: the tee, the green sod, and the fairway sod.

The multi-hole golfing facility 10 can have a clubhouse 110.

The multi hole golfing facility 10 is contemplated to have a plurality of water permeable and water shuttling sand bunkers 40*a*-40*g* made according to the method.

Each water permeable and water shuttling sand bunker 40*a*-40*g* can be created either: adjacent at least one of: the tee, the green, the fairway sod, and the rough sod.

The multi-hole golfing facility 10 is configured wherein the water flows from the continuous bunker edge over the one piece synthetic tufted surface through the non-woven dual smooth surfaced geo-textile to the drain assembly preventing contamination and clogging of the drain assembly while permitting a water flow rate from 6 inches to 24 inches of rain fall per hour forming a low maintenance water shuttling sand bunker for a multi-hole golfing facility.

Figure 2:
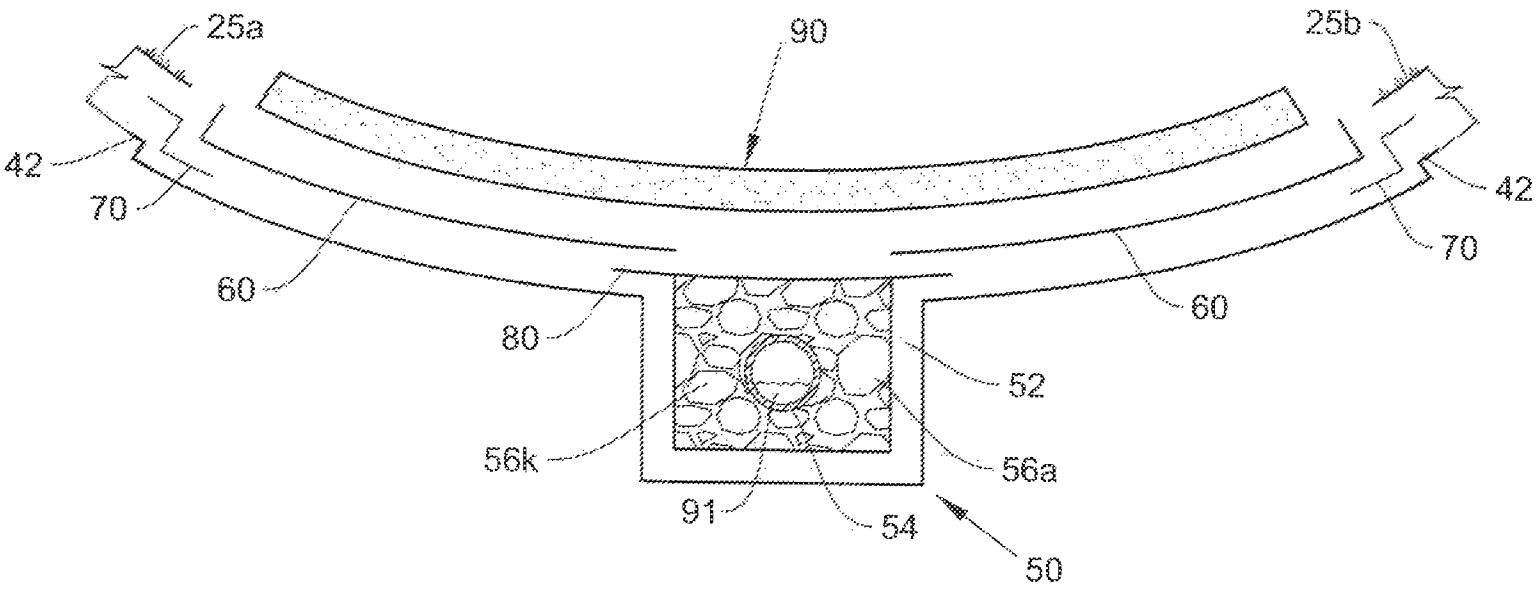
FIG. 2 depicts a section view of a detail of a water permeable and water shuttling sand bunker with drain assembly according to one or more embodiments.

FIG. 2 depicts a section view of a detail of a water permeable and water shuttling sand bunker 40 with drain assembly formed according to the method.

Each water permeable and water shuttling sand bunker has a continuous bunker edge 42 forming a perimeter of the water permeable and water shuttling sand bunker.

Each water permeable and water shuttling sand bunker has a drain assembly 50 positioned at a location to receive water falling on the water permeable and water shuttling sand bunker within the continuous bunker edge.

Each drain assembly 50 has a drainage trench 52.

A drainage pipe 54 is positioned in the drainage trench 52. The drainage pipe 54 fills from 30% and 40% of the drainage trench 52.

An aggregate material 56*a*-56*k* surrounds the drainage pipe 54 in the drainage trench 52.

This FIG. 2 shows a water permeable and water shuttling sand bunker made according to the method as having a one piece synthetic tufted surface 60 positioned to extend from the continuous bunker edge 42 towards the drain assembly 50 without covering the drain assembly 50.

Each water permeable and water shuttling sand bunker formed by the method has an overlapping polymer mesh 70.

The water permeable and water shuttling sand bunker has a non-woven dual smooth surfaced geo-textile 80 cradling the drain assembly 50. The non-woven dual smooth surfaced geo-textile 80 is positioned under from 5% to 30% of the one piece synthetic tufted surface 60. The non-woven geo-textile is configured for allowing water flow and water filtration while simultaneously excluding sand from entering the drain assembly 50.

The non-woven dual smooth surfaced geo-textile 80 is positioned under from 5% to 30% of the one piece synthetic tufted surface 60 and in this Figure extends from 6 inches to 14 inches under the one piece synthetic tufted surface 60.

In embodiments, the non-woven dual smooth surfaced geo-textile is adhered to the synthetic tufted surface with an adhesive.

The non-woven dual smooth surfaced geo-textile can be from 3 ounce to 5 ounce weight geo-textile.

In embodiments, the non-woven dual smooth surfaced geo-textile 80 provides cross-plane filtering with an apparent opening size (AOS) at least about 0.212 and a thickness greater than about 1.0 mm at 2 kPa normal load; and with an approximate mesh opening of #70 US Sieve, the non-woven dual smooth surfaced geo-textile can be formed by needle punching whereby the needle formed gaps in the geo-textile providing a greater than 1.7 cm/sec.

In embodiments, the non-woven dual smooth surfaced geo-textile 80 comprises high-modulus polymeric filaments comprising monofilaments or multifilament.

The non-woven dual smooth surfaced geo-textile 80 has a cross-plane water flow rate of greater than 4,885 liter/min/m.sup.2.

In embodiments, the non-woven dual smooth surfaced geo-textile 80 comprises at least 50% incompressible polypropylene (HDPP).

In embodiments, the non-woven dual smooth surfaced geo-textile 80 encapsulates the drain assembly, positioned under from 5% to 30% of the synthetic tufted surface 60, the non-woven dual smooth surfaced geo-textile configured for allowing water flow and water filtration while simultaneously excluding sand from entering the drain assembly 50 (shown in this FIG. 2).

The water permeable and water shuttling sand bunker 40 has a sand layer 90 simultaneously sufficiently thick to support a golfer and sufficiently porous to enable water removal at a flow rate of from 6 inches to 24 inches of rain fall per hour. The sand layer can have less than 2% fines. The sand layer can be disposed over the one piece synthetic tufted surface within the continuous bunker edge. The sand layer and one piece synthetic tufted surface provide a real time indicator for maintenance by golf course maintenance crews.

The sand layer 90 can be between 2 and 4 inches in thickness and can be uniformly over the one piece synthetic tufted surface.

In embodiments, the water permeable and water shuttling sand bunker has bowl shaped sides.

In embodiments, the sides of the shaped water permeable and water shuttling sand bunker slope from 10 degrees to 35 degrees.

In FIG. 2, sod 25*a* and 25*b* are shown positioned on sides of the water permeable and water shuttling sand bunker.

Water 91 is shown in the drainage pipe 54.

Figure 3:
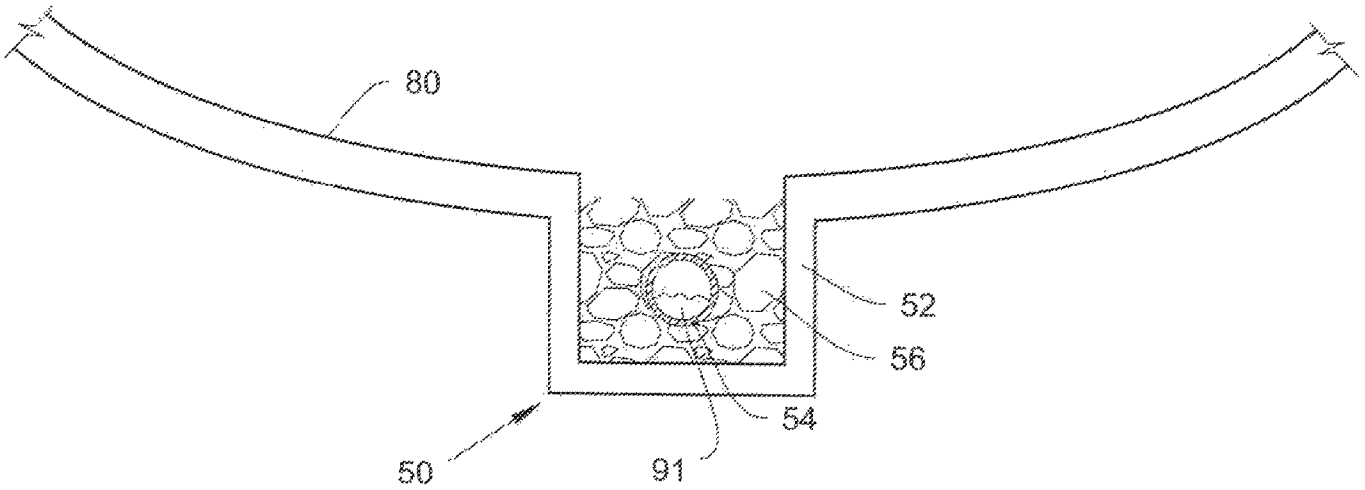
FIG. 3 depicts a cross section of the drain assembly according to one or more embodiments.

FIG. 3 depicts a cross section of the drain assembly 50 according to one or more embodiments.

The drain assembly 50 has a drainage trench 52.

A drainage pipe 54 can be installed in the drainage trench. The drainage pipe 54 fills from 30% and 40% of the drainage trench 52.

An aggregate material 56 can be depicted surrounding the drainage pipe 54 in the drainage trench 52.

In embodiments, the drainage pipe 54 can be perforated with sufficient holes that provide intake of water at a rate of 2% to 3% of the pipe volume per foot per minute and enabling out flows of from 16 gallons to 23 gallons per minute per foot.

A non-woven dual smooth surfaced geo-textile 80 is depicted.

Water 91 is shown in the drainage pipe 54.

Figure 4:
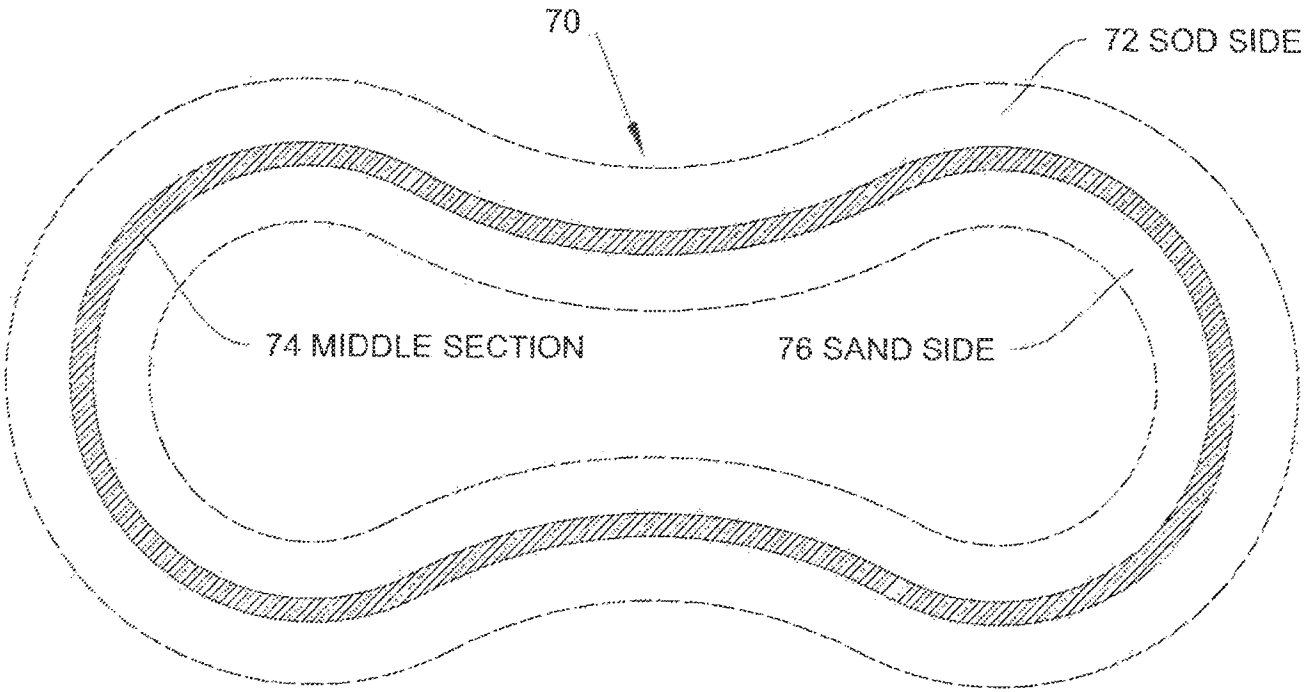
FIG. 4 depicts a top view of overlapping polymer mesh according to one or more embodiments.

FIG. 4 depicts a top view of overlapping polymer mesh 70 according to one or more embodiments.

The overlapping polymer mesh 70 has a sod side 72 mounted under the sod of a green, fairway sod or rough sod.

The overlapping polymer mesh 70 has a middle section 74 mounted over the continuous bunker edge integrally connected to the sod side.

The overlapping polymer mesh 70 has a sand side 76 which can be mounted under the synthetic tufted surface integrally connected to the middle section, In embodiments, the overlapping polymer mesh can be a non-woven polyvinyl chloride mesh.

In embodiments, the sod side of the overlapping polymer mesh extends from 6 to 14 inches, such as 12 inches under the sod of at least one of: the tee, the fairway sod, the rough sod and the green.

The sand side of the overlapping polymer mesh extends from 6 inches to 14 inches, such as 12 inches under the one piece synthetic tufted surface.

The overlapping polymer mesh can have a density of 10 strands per inch forming a porosity large enough to allow grass roots of sod or fasteners of sod to penetrate the holes formed therein.

Figure 5:
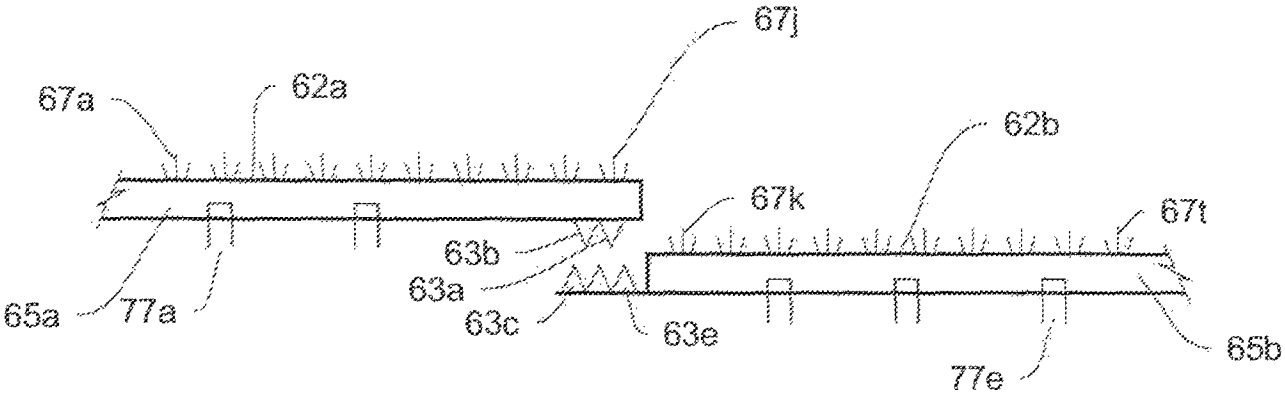
FIG. 5 depicts synthetic tufts on a plurality of non-permeable bases adhered together to form the one piece synthetic tufted surface according to embodiments.

FIG. 5 depicts synthetic tufts 67*a-t* on a plurality of non-permeable bases 65*a* and 65*b* adhered together to form the one piece synthetic tufted surface according to embodiments.

In this Figure, the one piece synthetic tufted surface can be made from a plurality of segmented tufted synthetic strips 62*a*-62*b*.

Each segmented tufted synthetic strip has a length from 100 to 200 feet and a width from 8 feet to 12 feet, and wherein each of the plurality of segmented synthetic strips are adhered together with an adhesive shown as elements 63*a* through 63*e*.

The adhesive can be a urethane based fast setting adhesive that sets within 2 to 4 hours.

In embodiments, the one piece synthetic tufted surface 60 covers 100% of the water permeable and water shuttling sand bunker from the continuous bunker edge towards the drain assembly 50.

The one piece synthetic tufted surface has a non-permeable base 65*a*-65*b* and a plurality of synthetic tufts 67*a*-67*t* protruding from the non-permeable base, wherein, the synthetic tufts have multiple fibers protruding from the non-permeable base at a height from/inch ¾ to 1 inch and wherein the synthetic tufts are spaced from each other from $5/16^{th}$ inch to ⅜ inches and the non-permeable base comprises a flexible bendable non-deforming non-breaking material at temperatures from 6 degrees Fahrenheit to 125 degrees Fahrenheit.

In embodiments, the overlapping polymer mesh has holes sufficient to accommodate grass root penetration from sod and fastener 77*a*-77*e* forming an anchor.

Figure 6:
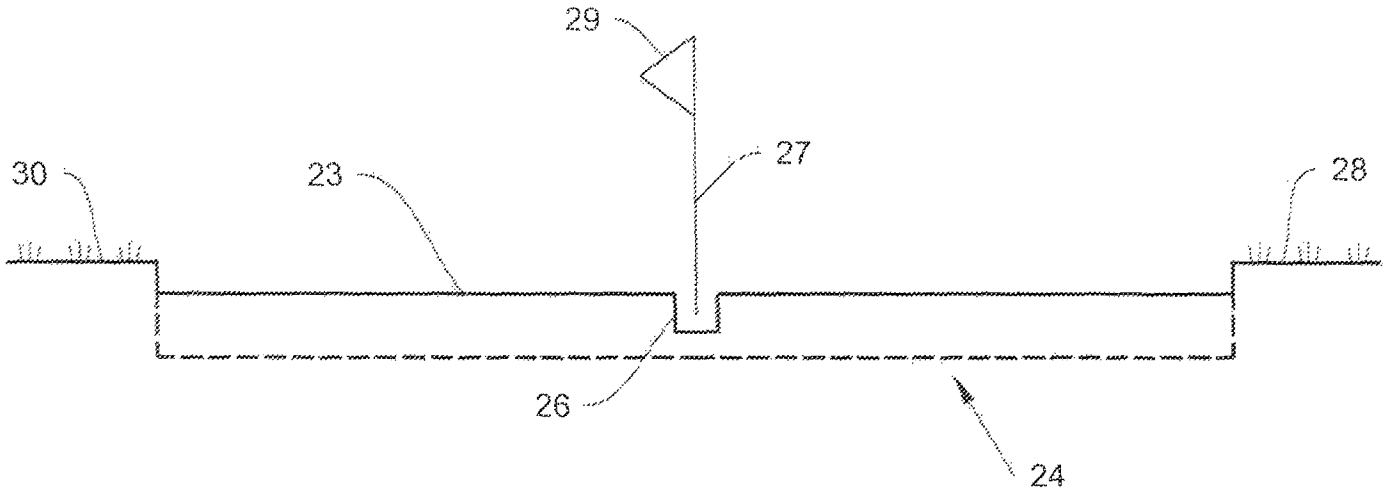
FIG. 6 is cross section of a green for receiving a golf ball with greens sod, a cup, a pin with a flag according to embodiments.

FIG. 6 is cross section of a green 24 for receiving a golf ball.

Green 24 has green sod 23, and a cup 26. The cup holds a pin 27 with a flag 29. The cup can be positioned in the green for receiving a golf ball.

Fairway sod 28 is shown adjacent the green 24.

Rough sod 30 is shown adjacent the green 24.

Figure 7:
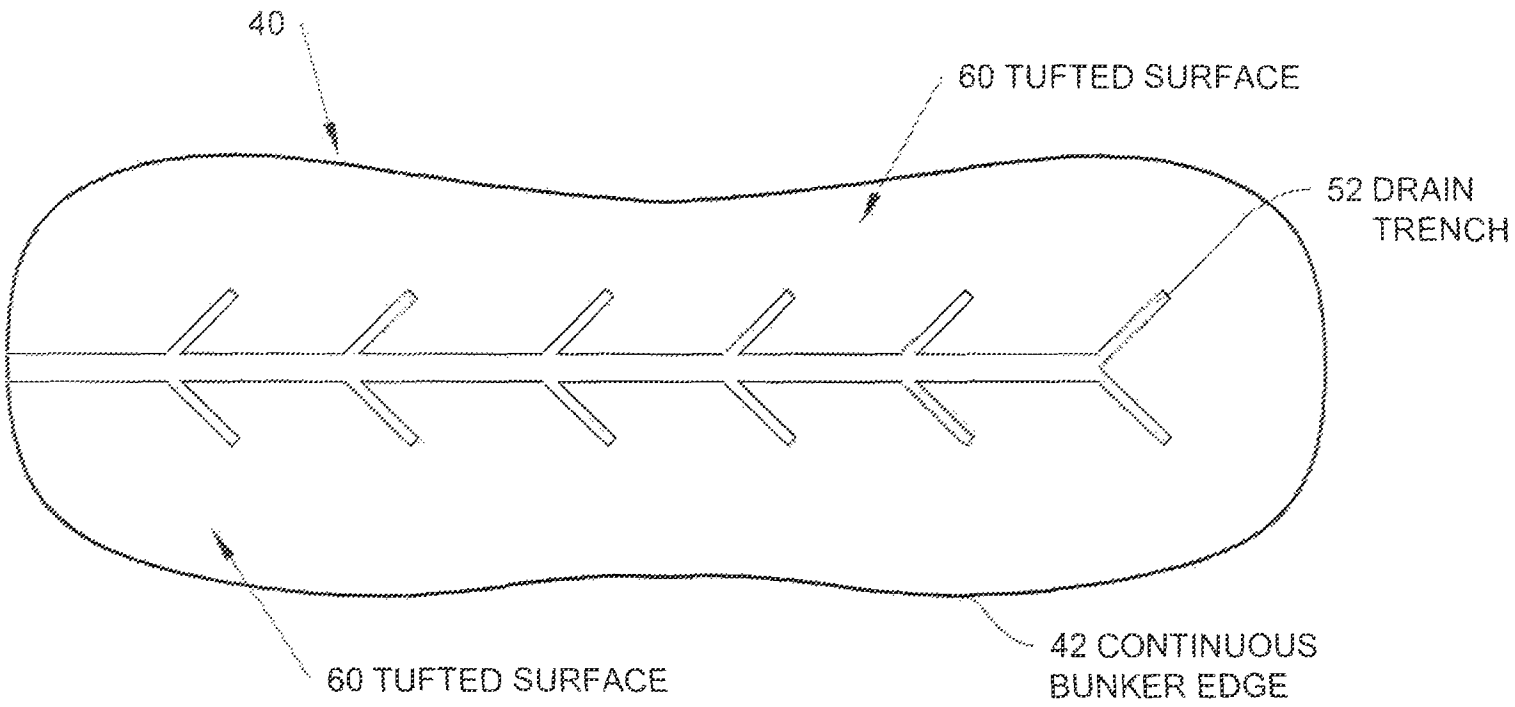
FIG. 7 is a top view of a water permeable and water shuttling sand bunker with one piece synthetic tufted surface with drainage assembly formed according to embodiments.

FIG. 7 is a top view of a water permeable and water shuttling sand bunker 60 with one piece synthetic tufted surface 60 and the drainage trench 52 according to embodiments.

The water permeable and water shuttling sand bunker 40 is shown from a top view with the continuous bunker edge 42 forming a perimeter of the water permeable and water shuttling sand bunker.

From this top view, a drain trench 52 can be seen positioned at a location to receive water falling on the water permeable and water shuttling sand bunker within the continuous bunker edge. The drainage trench 52 is shown extending longitudinally through the sand bunker.

The one piece synthetic tufted surface 60 is also depicted not covering the drainage trench.

Figure 8:
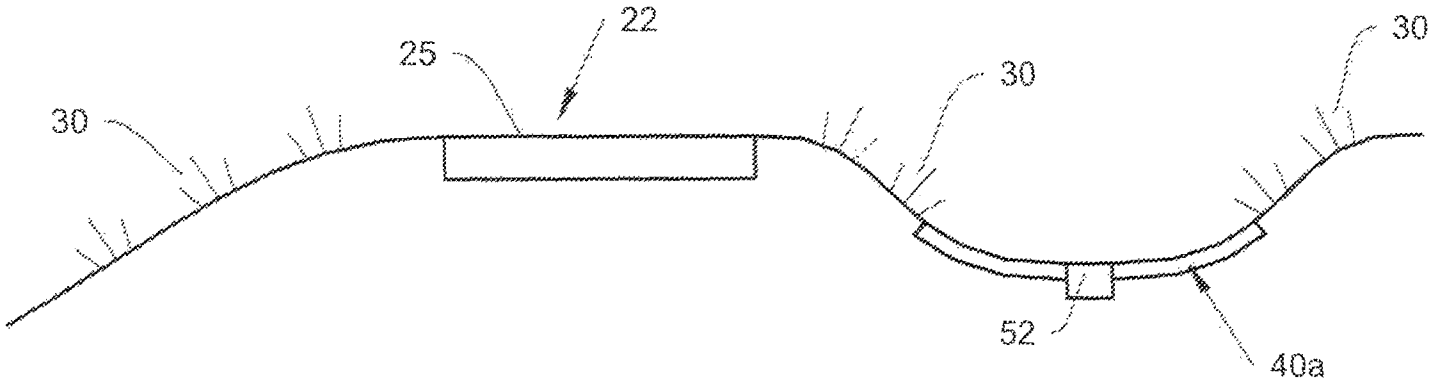
FIG. 8 is a cross section of a tee with sod proximate a water permeable and water shuttling sand bunker created according to the method.

FIG. 8 a cross section of a tee 22 with sod 25 proximate a water permeable and water shuttling sand bunker 40.

Rough sod 30 is shown in this Figure along with the drainage trench 52.

As an example, an accelerated water removal low maintenance multi-hole golfing facility can have 9 golf holes for play.

The first golf hole can be a par 4, and has a tee with sod, providing a location fbr striking a golf ball and rough sod. This first golf hold has fairway sod, more rough sod, and a green. Next to the green is a water permeable and water shuttling sand bunkers.

The second golf hole is a par 3. This second hole has a tee with sod, providing a location for striking a golf ball and rough sod. This second golf hole has no fairway sod, more rough sod, and a green. Next to the green is a water permeable and water shuttling sand bunker.

The third golf hole is a par 5. This third hole has a tee with sod, providing a location for striking a golf ball and rough sod. This third golf hole has fairway sod and a water permeable and water shuttling sand bunker next to the fairway sod. This third hole has a green with rough sod next to the green.

The fourth golf hole is a par 4. This fourth hole has a tee with sod, providing a location for striking a golf ball and rough sod. A water permeable and water shuttling sand bunker is positioned next to the tee. This hole has fairway sod, a green and rough sod next to the green.

The fifth golf hole is a par 4. This fifth hole has a tee with sod, providing a location for striking a golf ball and rough sod. This fifth golf hole has fairway sod and two water permeable and water shuttling sand bunker positioned on either side of the fairway sod. This fifth hole has a green with rough sod next to the green.

The sixth golf hole is a par 4. This sixth hole has a tee with sod, providing a location for striking a golf ball and rough sod. This sixth golf hole has fairway sod and a green. A water permeable and water shuttling sand bunker is positioned next to the green with rough sod also next to the green.

The seventh golf hole is a par 3. This seventh hole has a tee with sod, providing a location for striking a golf ball and rough sod. Two water permeable and water shuttling sand bunker are used, one is next to the tee, and one is next to the green. No fairway sod is used for this hole. This seventh hole has a green with additional rough sod next to the green.

The eighth golf hole is a par 4. This eighth hole has a tee with sod, providing a location for striking a golf ball and rough sod. This eighth golf hole has fairway sod and no water permeable and water shuttling sand bunker. This eighth hole has a green with rough sod next to the green.

The last and ninth golf hole is a par 5. This ninth hole has a tee with sod, providing a location for striking a golf ball and rough sod. This ninth golf hole has fairway sod and a water permeable and water shuttling sand bunker next to the fairway sod. This ninth hole has a green with rough sod next to the green.

When it rains, this multi-hole golfing facility has rain water flowing onto the water permeable and water shuttling sand bunkers. Water flows from each water permeable and water shuttling sand bunker's continuous bunker edge over the one piece synthetic tufted surface through the non-woven dual smooth surfaced geo-textile to the drain assembly. Water is filtered by the assembly preventing contamination and clogging of the drain assembly while permitting a water flow rate from 6 inches to 24 inches of rain fall per hour away from the drain assembly. The water permeable and water shutting and bunkers form a low maintenance a multi-hole golfing facility which has a visual indicator when the sand bunker needs additional sand.

In this example, each of the water permeable and water shuttling sand bunkers created by the method is positioned either adjacent at least one of: the tee, the green, the fairway sod, and the rough sod.

In this specific example, each water permeable and water shuttling sand bunker has a continuous bunker edge forming a perimeter of the water permeable and water shuttling sand bunker. In the first two holes, the perimeter is 40 feet. Golf hole 3 and 4 have a continuous bunker edge 300 feet long. Golf holes 5 and 6 each have a continuous bunker edge 100 and 250 feet long, respectively. Golf hole 7 has a continuous bunker edge that is 650 feet long and another that is 225 feet long. Golf hole 9 has continuous bunker edge that is 125 feet long.

Each of the water permeable and water shuttling sand bunkers formed according to this method can have a drain assembly 50 positioned at a location to receive water falling on the water permeable and water shuttling sand bunker within the continuous bunker edge.

For golf holes, the drainage trench varies in size based on the perimeter of the holes. For golf hole 1 the drainage trench is 6 feet long. For golf hole 2 the drainage trench is 6 feet long. For golf hole 3 the drainage trench is 45 feet long. For golf hole 4 the drainage trench is 45 feet long. For golf hole 5 the drainage trench is 15 feet long. For golf hole 6 the drainage trench is 30 feet long. For golf hole 7 the drainage trench is 98 feet and 34 feet long respectively. For golf hole 9, the drainage trench is 19 feet long.

A drainage pipe 54 can fill each drainage trench.

Each drainage pipe can fill from 30% and 40% of the drainage trench which means, each drainage pipe varies in outer diameter.

For golf hole 1 the drainage pipe has an outer diameter of 4 inches. For golf hole 2 the drainage pipe has an outer diameter of 4 inches. For golf hole 3 the drainage pipe has an outer diameter of 6 inches. For golf hole 4 the drainage pipe has an outer diameter of 6 inches. For golf hole 5 the drainage pipe has an outer diameter of 4 inches. For golf hole 6 drainage pipe has an outer diameter of 4 inches. For golf hole 7 the drainage pipe for both has an outer diameter of 6 inches. For golf hole 9, the drainage pipe has an outer diameter of 4 inches.

For each of the golf holes, the aggregate material surrounding each drainage pipe in each drainage trench can be the same material. The aggregate material can change in volume.

For all the golf holes, the aggregate material volume is from 60 to 70% the volume of the drainage trench.

For each golf hole, a one piece synthetic tufted surface 60 positioned to extend from the continuous bunker edge 42 towards the drain assembly 50 without covering the drain assembly. However, the surface area of the one piece synthetic tufted surface changes for each water permeable and water shuttling sand bunker.

For golf hole 1, the surface area of the one piece synthetic tufted surface can be 100 square feet.

For golf hole 2, the surface area of the one piece synthetic tufted surface can be 100 square feet.

For golf hole 3, the surface area of the one piece synthetic tufted surface can be 5625 square feet.

For golf hole 4, the surface area of the one piece synthetic tufted surface can be can be 5625 square feet.

For golf hole 5, the surface area of the one piece synthetic tufted surface can be 625 square feet.

For golf hole 6, the surface area of the one piece synthetic tufted surface can be 625 square feet.

For golf hole 7, the surface area of the one piece synthetic tufted surface can be 26,406 square feet and 4064 square feet respectively.

For golf hole 9, the surface area of the one piece synthetic tufted surface can be 976 square feet.

For each golf hole, the overlapping polymer mesh provides a one piece mesh wherein the sod side and the middle section are in a 1:1 ratio and the middle section and the sand side are in a 1:1 ratio. In embodiments, the sod side and the middle section can be in a ratio of 0.5:1.5 to 2 and the middle section to the sand side are in a ratio of 2-1.5:0.5. In embodiments, the overlapping polymer mesh is a one layer mesh.

In three of the holes, the middle section can be 4 inches in width with the sand side and the sod side each being 7 inches in width.

Fasteners can be used, one every square foot for each of the sand bunkers to hold the synthetic tufted surface to the overlapping polymer mesh, the non-woven dual smooth surfaced geotextile and native soil forming a plurality of anchors.

For each sand bunker one layer of non-woven dual smooth surfaced geo-textile cradles the drain assembly. For golf holes 1 and 2, the non-woven dual smooth surfaced geo-textile is positioned under 6% of the synthetic tufted surface.

For golf hole 3 and 4, the non-woven dual smooth surfaced geo-textile is positioned under 8% of the synthetic tufted surface.

For golf hole 5, the non-woven dual smooth surfaced geo-textile is positioned under 17% of the synthetic tufted surface.

For golf hole 6, the non-woven dual smooth surfaced geo-textile is positioned under 30% of the synthetic tufted surface.

For golf hole 7, the non-woven dual smooth surfaced geo-textile is positioned under 20% of the synthetic tufted surface.

For golf hole 9, the non-woven dual smooth surfaced geo-textile is positioned under 21% of the synthetic tufted surface For each golf hole, the non-woven geo-textile is configured for allowing water flow and water filtration while simultaneously excluding sand from entering the drain assembly.

Each water permeable and water shuttling sand bunker of each golf hole has a sand layer 90.

Each water permeable and water shuttling sand bunker's sand layer is simultaneously sufficiently thick to support a golfer and sufficiently porous to enable water removal at a flow rate of from 6 to 24 inches of rain fall per hour, the sand layer comprising less than 2% fines, disposed over the one piece synthetic tufted surface within the continuous bunker edge.

For each water permeable and water shuttling sand bunker, the bottom of the bunker is 4 inches thick and then the sand layer tapers to 2 inches as the sand layer approaches the continuous bunker edge.

In all the bunkers, the sand layer and one piece synthetic tufted surface provide a real time indicator for maintenance by golf course maintenance crews.

Figure 9A:
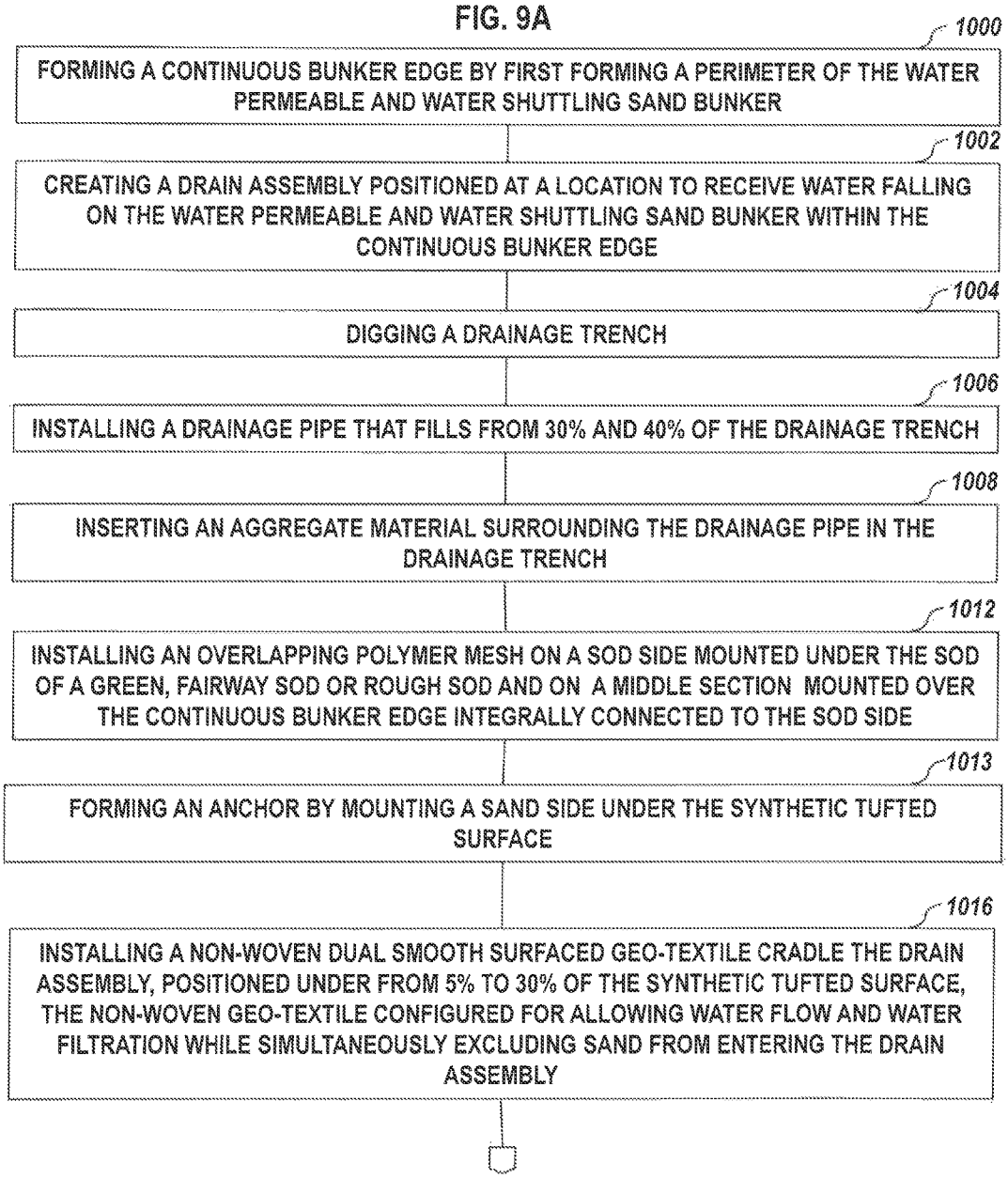
FIGS. 9A-9C is an embodiment of a sequence of steps to perform the method for making a water permeable and water shuttling sand bunker, each water permeable and water shuttling sand bunker positioned either: adjacent at least one of: the tee, the green, the fairway sod, and the rough sod.
Figure 9B:
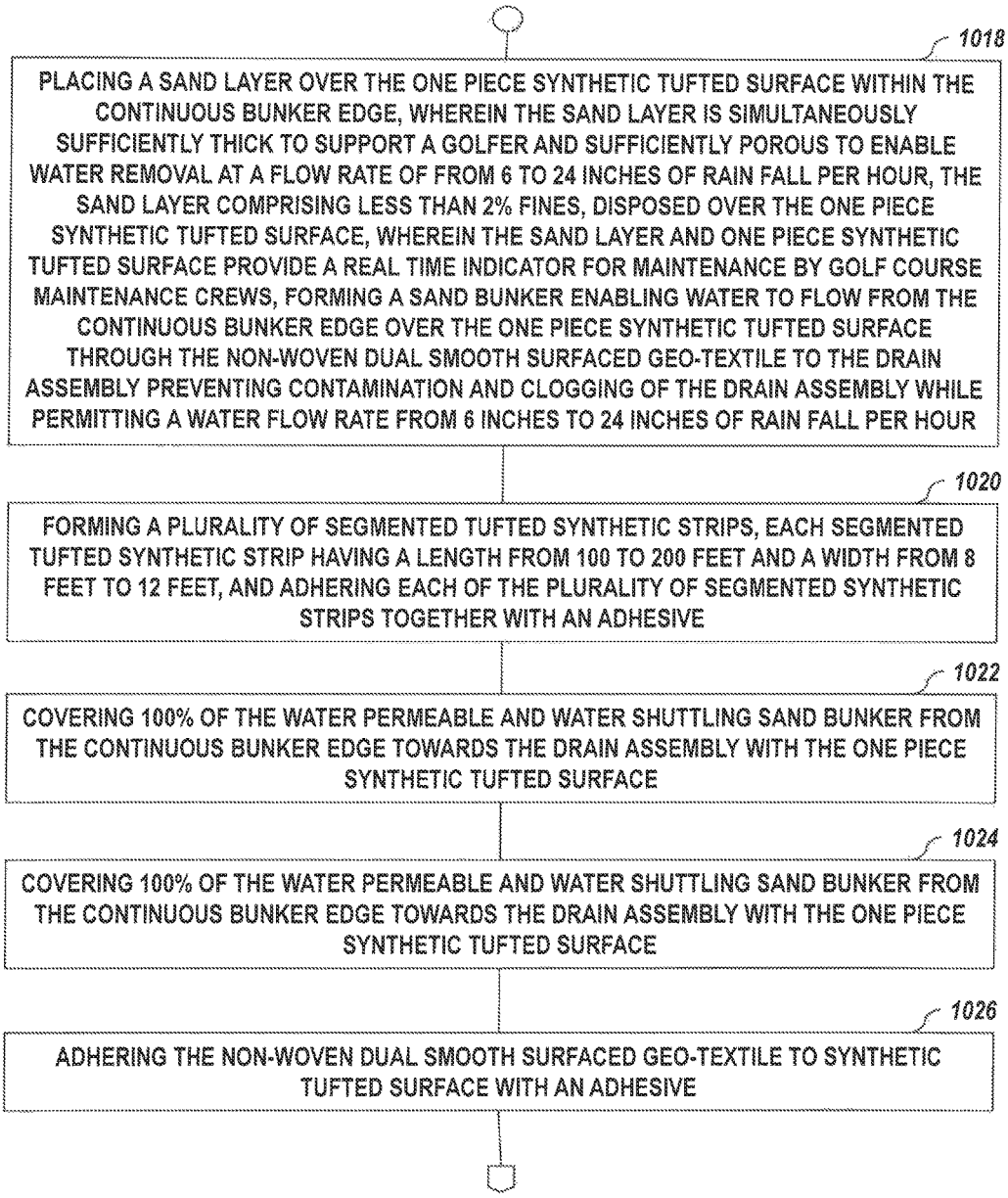
Figure 9C:
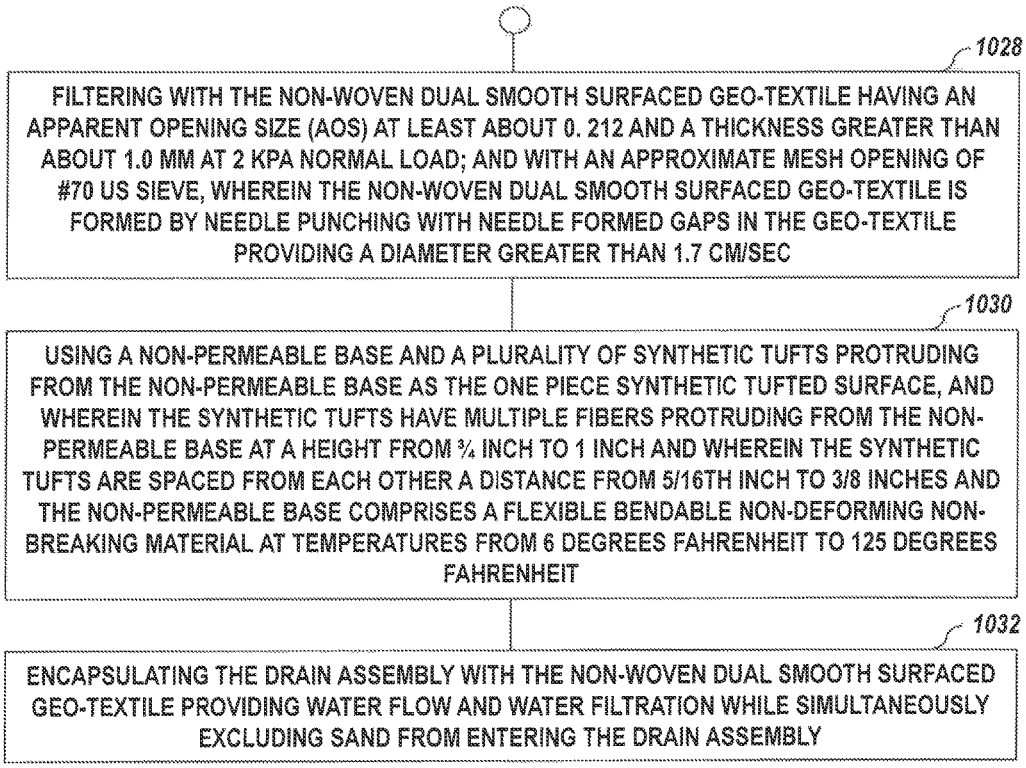

FIG. 9A-9C depicts a sequence of steps to perform the method.

The steps of the method involve as Step 1000 forming a continuous bunker edge by first forming a perimeter of the water permeable and water shuttling sand bunker.

Step 1002 involves creating a drain assembly positioned at a location to receive water falling on the water permeable and water shuttling sand bunker within the continuous bunker edge.

The drain assembly is created by the steps of: Step 1004 digging a drainage trench 52; Step 1006 installing a drainage pipe 54 that fills from 30% and 40% of the drainage trench; and Step 1008 inserting an aggregate material 56 surrounding the drainage pipe in the drainage trench.

Step 1010 involves positioning a one piece synthetic tufted surface to extend from the continuous bunker edge towards the drain assembly without covering the drain assembly.

Step 1012 involves installing an overlapping polymer mesh 70 on a sod side 72 mounted under the sod of a green, fairway sod or rough sod and on a middle section 74 mounted over the continuous bunker edge integrally connected to the sod side.

Step 1013 includes forming an anchor by mounting a sand side under the synthetic tufted surface.

Step 1014 involves integrally connecting the overlapping polymer mesh to the synthetic tufted surface, wherein the overlapping polymer mesh comprises holes sufficient to accommodate grass root penetration from sod.

Step 1016 installing a non-woven dual smooth surfaced geo-textile 80 cradle the drain assembly, positioned under from 5% to 30% of the synthetic tufted surface 60, the non-woven geo-textile configured for allowing water flow and water filtration while simultaneously excluding sand from entering the drain assembly.

Step 1018 involves placing a sand layer 90 over the one piece synthetic tufted surface within the continuous bunker edge, wherein the sand layer is simultaneously sufficiently thick to support a golfer and sufficiently porous to enable water removal at a flow rate of from 6 to 24 inches of rain fall per hour, the sand layer comprising less than 2% fines, disposed over the one piece synthetic tufted surface, wherein the sand layer and one piece synthetic tufted surface provide a real time indicator for maintenance by golf course maintenance crews, forming a sand bunker enabling water to flow from the continuous bunker edge over the one piece synthetic tufted surface through the non-woven dual smooth surfaced geo-textile to the drain assembly preventing contamination and clogging of the drain assembly while permitting a water flow rate from 6 inches to 24 inches of rain fall per hour.

Step 1020 includes an embodiment of forming a plurality of segmented tufted synthetic strips, each segmented tufted synthetic strip having a length from 100 to 200 feet and a width from 8 feet to 12 feet, and adhering each of the plurality of segmented synthetic strips together with an adhesive.

Step 1022 involves covering 100% of the water permeable and water shuttling sand bunker from the continuous bunker edge towards the drain assembly with the one piece synthetic tufted surface.

Step 1024 involves positioning the non-woven dual smooth surfaced geo-textile under from 5% to 30% of the synthetic tufted surface and extending the non-woven dual smooth surfaced geo-textile from 6 inches to 14 inches under the synthetic tufted surface.

Step 1026 involves adhering the non-woven dual smooth surfaced geo-textile to synthetic tufted surface with an adhesive.

Step 1028 involves cross plane filtering with the non-woven dual smooth surfaced geo-textile having an apparent opening size (AOS) at least about 0.212 and a thickness greater than about 1.0 mm at 2 kPa normal load; and with an approximate mesh opening of #70 US Sieve, wherein the non-woven dual smooth surfaced geo-textile is formed by needle punching with needle formed gaps in the geo-textile providing a diameter greater than 1.7 cm/sec.

Step 1030 involves using a non-permeable base and a plurality of synthetic tufts protruding from the non-permeable base as the one piece synthetic tufted surface, and wherein the synthetic tufts have multiple fibers protruding from the non-permeable base at a height from ¾ inch to 1 inch and wherein the synthetic tufts are spaced from each other a distance from $5/16^{th}$ inch to ⅜ inches and the non-permeable base comprises a flexible bendable non-deforming non-breaking material at temperatures from 6 degrees Fahrenheit to 125 degrees Fahrenheit.

Step 1032 involves encapsulating the drain assembly with the non-woven dual smooth surfaced geo-textile providing water flow and water filtration while simultaneously excluding sand from entering the drain assembly.

In an embodiment of the method, the sand bunker can be created by forming sides of the shaped water permeable and water shuttling sand bunker at a slope from 10 degrees to 35 degrees.

In an embodiment of the method, the sand bunker can be created by using a non-woven polyvinyl chloride mesh as the overlapping polymer mesh.

In an embodiment of the method, the sand bunker can be created by extending the sod side of the overlapping polymer mesh from 6 to 14 inches under the sod of at least one of: a tee, a fairway sod, a rough sod and a green.

In an embodiment of the method, the sand bunker can be created by extending the sand side of the overlapping polymer mesh from 6 to 14 inches under the one piece synthetic tufted surface.

In an embodiment of the method, the sand bunker can be created using an overlapping polymer mesh with a density of 10 strands per inch and a porosity large enough to allow grass roots of sod or fasteners of sod to penetrate the holes formed therein.

In an embodiment of the method, the sand bunker can be created by using as the adhesive a urethane based fast setting adhesive that sets within 2 to 4 hours.

In an embodiment of the method, the sand bunker can be created by making a water permeable and water shuttling sand bunker of claim 1, comprising using from 3 ounce to 5 ounce weight non-woven dual smooth surfaced geo-textile.

In an embodiment of the method, the sand bunker can be created by making a water permeable and water shuttling sand bunker of claim 1, comprising using a plurality of high-modulus polymeric monofilament or multifilament non-woven dual smooth surfaced geo-textile.

In an embodiment of the method, the sand bunker can be created by using at least 50% incompressible polypropylene (HDPP) as the non-woven dual smooth surfaced geo-textile.

In an embodiment of the method, the sand bunker can be created by installing a sand layer with a thickness from 2 inches to 4 inches uniformly over the one piece synthetic tufted surface.

In an embodiment of the method, the sand bunker can be created by perforating the drainage pipe with sufficient holes to provide water intake at a rate from 2% to 3% of the pipe volume per foot per minute enabling out flows of water at a rate from 16 gallons to 23 gallons per minute per foot.

While these embodiments have been described with emphasis on the embodiments, it should be understood that within the scope of the appended claims, the embodiments might be practiced other than as specifically described herein.

What is claimed is:

1. A method for making a water permeable and water shuttling sand bunker, each water permeable and water shuttling sand bunker positioned either: adjacent at least one of: the tee, the green, the fairway sod, and the rough sod; the steps of the method comprising:

(i) forming a continuous bunker edge by first forming a perimeter of the water permeable and water shuttling sand bunker;

(ii) creating a drain assembly positioned at a location to receive water falling on the water permeable and water shuttling sand bunker within the continuous bunker edge; by the steps of;

(a) digging a drainage trench;

(b) installing a drainage pipe that fills from 30% and 40% of the drainage trench; and (c) inserting an aggregate material surrounding the drainage pipe in the drainage trench;

(iii) installing an overlapping polymer mesh on a sod side mounted under the sod of a green, fairway sod or rough sod and on a middle section mounted over the continuous bunker edge integrally connected to the sod side;

(iv) forming an anchor by mounting a sand side under a synthetic tufted surface;

(v) installing a non-woven dual smooth surfaced geo-textile to cradle the drain assembly, positioned under from 5% to 30% of the synthetic tufted surface, the non-woven geo-textile configured for allowing water flow and water filtration while simultaneously excluding sand from entering the drain assembly;

(vi) placing a sand layer over the one piece synthetic tufted surface within the continuous bunker edge, wherein the sand layer is simultaneously sufficiently thick to support a golfer and sufficiently porous to enable water removal at a flow rate of from 6 to 24 inches of rain fall per hour, the sand layer comprising less than 2% fines, disposed over the one piece synthetic tufted surface, wherein the sand layer and one piece synthetic tufted surface provide a real time indicator for maintenance by golf course maintenance crews; forming a sand bunker enabling water to flow from the continuous bunker edge over the one piece synthetic tufted surface through the non-woven dual smooth surfaced geo-textile to the drain assembly preventing contamination and clogging of the drain assembly while permitting a water flow rate from 6 inches to 24 inches of rain fall per hour.

2. The method for making a water permeable and water shuttling sand bunker of claim 1 comprising: forming sides of the shaped water permeable and water shuttling sand bunker at a slope from 10 degrees to 35 degrees.

3. The method for making a water permeable and water shuttling sand bunker of claim 1, comprising: using a non-woven polyvinyl chloride mesh as the overlapping polymer mesh.

4. The method for making water permeable and water shuttling sand bunker of claim 1, comprising: extending the sod side of the overlapping polymer mesh from 6 to 14 inches under the sod of at least one of: a tee, a fairway sod, a rough sod and a green.

5. The method for making a water permeable and water shuttling sand bunker of claim 1, comprising: extending the sand side of the overlapping polymer mesh from 6 to 14 inches under the synthetic tufted surface.

6. The method for making a water permeable and water shuttling sand bunker of claim 1, comprising: using an overlapping polymer mesh with a density of 10 strands per inch and a porosity large enough to allow grass roots of sod or fasteners of sod to penetrate the holes formed therein.

7. The method for making a water permeable and water shuttling sand bunker of claim 1, comprising: forming a plurality of segmented tufted synthetic strips, each segmented tufted synthetic strip having a length from 100 to 200 feet and a width from 8 feet to 12 feet, and adhering each of the plurality of segmented synthetic strips together with an adhesive.

8. The method for making a water permeable and water shuttling sand bunker of claim 1, comprising: covering 100% of the water permeable and water shuttling sand bunker from the continuous bunker edge towards the drain assembly with the synthetic tufted surface.

9. The method for making water permeable and water shuttling sand bunker of claim 7, comprising using as the adhesive a urethane based fast setting adhesive that sets within 2 to 4 hours.

10. The method for making a water permeable and water shuttling sand bunker of claim 1, comprising the step of positioning the non-woven dual smooth surfaced geo-textile under from 5% to 30% of the synthetic tufted surface and extending the non-woven dual smooth surfaced geo-textile from 6 inches to 14 inches under the synthetic tufted surface.

11. The method for making a water permeable and water shuttling sand bunker of claim 1, comprising adhering the non-woven dual smooth surfaced geo-textile to synthetic tufted surface with an adhesive.

12. The method for making a water permeable and water shuttling sand bunker of claim 1, comprising using from 3 ounce to 5 ounce weight non-woven dual smooth surfaced geo-textile.

13. The method for making a water permeable and water shuttling sand bunker of claim 1, comprising the step of cross plane filtering with the non-woven dual smooth surfaced geo-textile having an apparent opening size (AOS) at least about 0.212 mm and a thickness greater than about 1.0 mm at 2 kPa normal load; and with an approximate mesh opening of #70 US Sieve, wherein the non-woven dual smooth surfaced geo-textile is formed by needle punching with needle formed gaps in the geo-textile providing a diameter greater than 1.7 cm/sec.

14. The method for making a water permeable and water shuttling sand bunker of claim 1, comprising using a plurality of high-modulus polymeric monofilament or multifilament non-woven dual smooth surfaced geo-textile.

15. The method for making a water permeable and water shuttling sand bunker of claim 1, comprising using at least 50% incompressible polypropylene (HDPP) as the non-woven dual smooth surfaced geo-textile.

16. The method for making a water permeable and water shuttling sand bunker of claim 1, comprising installing a sand layer with a thickness from 2 inches to 4 inches uniformly over the synthetic tufted surface.

17. The method for making a water permeable arid water shuttling sand bunker of claim 1, comprising the step of perforating the drainage pipe with sufficient holes to provide water intake at a rate from 2% to 3% of the pipe volume per foot per minute enabling out flows of water at a rate from 16 gallons to 23 gallons per minute per foot.

18. The method for making a water permeable and water shuttling sand bunker of claim 1, comprising using a non-permeable base and a plurality of synthetic tufts protruding from the non-permeable base as the synthetic tufted surface, and wherein the synthetic tufts have multiple fibers protruding from the non-permeable base at a height from ¾ inch to 1 inch and wherein the synthetic tufts are spaced from each other a distance from $5/16^{th}$ inch to ⅜ inches and the non-permeable base comprises a flexible bendable non-deforming non-breaking material at temperatures from 6 degrees Fahrenheit to 125 degrees Fahrenheit.

19. The method for making a water permeable and water shuttling sand bunker of claim 1, comprising: encapsulating the drain assembly with the non-woven dual smooth surfaced geo-textile providing water flow and water filtration while simultaneously excluding sand from entering the drain assembly.

20. The method for making, a water permeable and water shuttling sand bunker of claim 1 comprising positioning the synthetic tufted surface to extend from the continuous bunker edge towards the drain assembly without covering the drain assembly.

21. The method for making a water permeable and water shuttling sand bunker of claim 1 comprising integrally connecting the overlapping polymer mesh to the synthetic tufted surface, wherein the overlapping polymer mesh comprises holes sufficient to accommodate grass root penetration from sod.

* * * * *